United States Patent [19]

Raetz

[11] 3,931,486

[45] Jan. 6, 1976

[54] PENDANT SWITCH ASSEMBLY FOR HOISTS

[75] Inventor: Rolf Lutz Manfred Raetz, Essen, Germany

[73] Assignee: Eaton Corporation, Ohio

[22] Filed: July 29, 1974

[21] Appl. No.: 492,656

[52] U.S. Cl. ..... 200/157; 200/153 LB

[51] Int. Cl.[2] ..... H01H 21/10

[58] Field of Search .. 200/157, 153 LB, 339, 61.85, 200/5 R; 338/128, 130, 215

[56] References Cited

UNITED STATES PATENTS

| | | | |
|---|---|---|---|
| 3,511,951 | 5/1970 | Miller | 200/157 |
| 3,704,355 | 11/1972 | Lichenvort et al. | 200/157 |
| 3,725,624 | 4/1973 | Emmons | 200/157 |
| 3,769,480 | 10/1973 | Lee | 200/157 |

*Primary Examiner*—James R. Scott
*Assistant Examiner*—William J. Smith
*Attorney, Agent, or Firm*—Teagno & Toddy

[57] ABSTRACT

A hand-held pendant control for remotely mounted hoists has a human engineered control handle portion and a body portion within which various hoist switches are compactly mounted and actuated by a main actuator on the handle portion. The pendant handle is formed to conform to a hand of the hoist operator and has the main actuator, a single rocker member, recess mounted in the handle to be activated by the thumb of the hand holding the handle. The body portion of the pendant has a series of adjoining micro-switches mounted on a mounting plate which is retained between a pair of end formed slots within the body portion of the pendant. A shaft having a series of stepped sections is connected to the main actuator to be rotated thereby with the stepped portions actuating various of the micro-switches at various rotation positions. The shaft is springbiased toward a neutral position and has a pressure catch assembly for retaining the shaft in the various switch actuating positions against the force of the biasing spring.

9 Claims, 8 Drawing Figures

PENDANT SWITCH ASSEMBLY FOR HOISTS

BACKGROUND OF THE INVENTION

1. Field of the Invention

The present invention relates to pendant control assemblies generally and particularly to hoist pendant controls for actuating various hoist operations in response to a predetermined movement of a single main pendant control member.

2. Description of the Prior Art

Hoist pendant control assemblies are known wherein actuation of different main control switches by an operator will develop different hoist functions such as raising or lowering a load at different speeds. Such pendants are usually not human engineered to allow the pendant to be easily grasped and retained in the hand of the operator while allowing the thumb of the hand grasping the pendant to perform all the necessary hoisting operations by moving a single main actuator. The pendant is usually a box-like structure which is held in one hand by the hoist operator with his other hand being required to operate the various different control switches. This causes operator fatigue and allows improper hoist operation by accidentally actuating a different control switch from the one intended.

Even in known pistol grip type pendants the speed of the hoisting operation is controlled by one switch, usually finger operated, which switch is used in combination with two other hoisting direction switches, which are usually thumb operated. Thus, even though the pistol pendant grip is somewhat human engineered, the operation of the various switching functions is still complex and requires extraordinary manual dexterity on the part of the hoist operator.

Another problem with the prior art hoist pendant controls occurs in their assembly. The individual control elements actuated by the operator control switches, as well as the associated elements such as the main control switch, are usually individually assembled directly to the pendant housing. This results in a bulky and complicated pendant which is difficult and costly to assemble. The lack of space within the assembled pendant housing also makes not only assembly but troubleshooting difficult.

The mentioned problems of the prior art devices as well as other problems are overcome by the human engineered hoist pendant control of the present invention.

SUMMARY OF THE INVENTION

The hoist pendant control of the present invention is human engineered to be easily gripped by the hand of a hoist operator and to allow control of all necessary hoisting functions by the normal thumb operation of a single rocker actuator. Further, the hoist control elements along with the rocker actuator are first assembled to a mounting board into a sub-assembly outside of the pendant housing. This sub-assembly is then easily retained in the pendant between a pair of grooves available for sliding the assembled mounting board therebetween.

To accomplish the above, the hoist pendant control assembly has a housing which forms a handle portion for easily grasping the pendant and a main body portion enclosing various hoist control elements and switches. A main control actuator, which could be the rocker member, is located proximately to the handle to allow easy movement of this actuator to a plurality of control positions by the thumb of the operator grasping the handle. The different positions of the main actuator actuate different hoist control switches in the body of the housing through a stepped shaft which is connected to the main actuator and which is located proximately to the various control switches.

To provide a speedy and economical assembly of the pendant control, the various control switches are mounted to a mounting board or base plate which is easily retained between a pair of grooves formed in the body section of the housing. Supports are further mounted on this base plate to retain the rocker member and the switch actuating shaft to the base plate. This allows the base plate sub-assembly to be easily removed and inserted into the pendant housing facilitating speedy and economical first assembly as well as troubleshooting which may require removal of the base plate sub-assembly.

It may thus be seen that one feature of the present invention is to provide a human engineered pendant control which is easily grasped and operated through a single actuator.

Another feature of the present invention is to provide a pendant control which is easily and economically assembled and disassembled.

These and other features of the present invention will become clearer after due consideration of the following description of the preferred embodiment and its accompanying drawings.

DESCRIPTION OF THE PREFERRED EMBODIMENT

Figure 1:
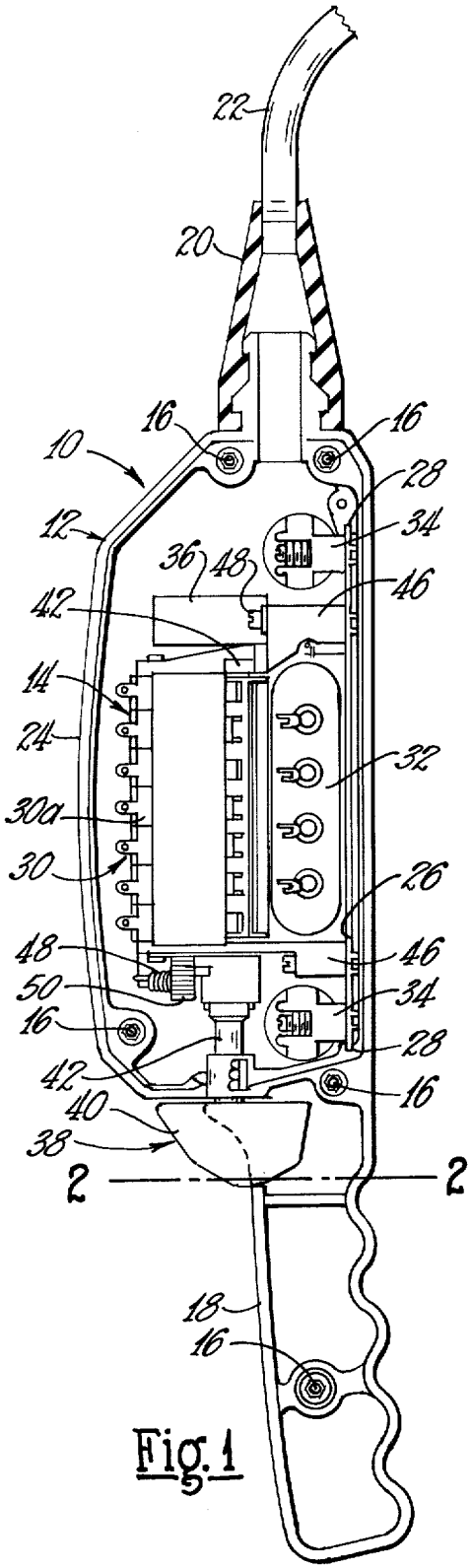
FIG. 1 is a lateral view of one-half of the center divided housing of the present invention with the control elements mounted therein.
Figure 2:
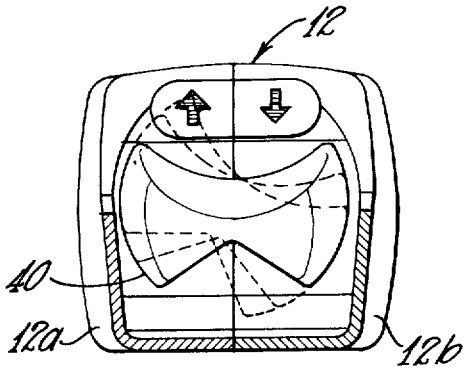
FIG. 2 is a sectional view along line 2—2 of FIG. 1.

Referring now to the drawings generally, and FIGS. 1 and 2 in particular, a pendant hoist control assembly 10 is shown as having a center divided housing 12 within which is mounted a control element sub-assembly 14.

The center divided housing 12 is formed from two matching halves 12*a* and 12*b* which are easily assembled by screws 16. The housing is formed to have a handle portion which is comfortably grasped in one hand of a hoist operator. Formed at the opposite end of the housing 12 is a sleeve 20 through which a control line 22 is strain relieved and through which line 22 connects the pendant 10 to a remotely mounted hoist (not shown). Formed between the handle 18 and the sleeve 22 is a main body portion 24 within which various control elements of the control element sub-assembly 14 are compactly mounted to a base plate 26. The base plate 26 and consequently, the control element sub-assembly is easily assembled within the main body 24 of the housing 12 by sliding the base plate into a pair of retaining grooves 28 formed at opposite ends of one side of the main body 24. Once the base plate is inserted into the grooves 28 of one of the housing halves 12a the other identical housing half 12b is joined to the first half **12*a* and the two are screwed together by the screws 16 to effectively capture the control element sub-assembly within the housing 12 of the pendant assembly 10**.

Figure 4:
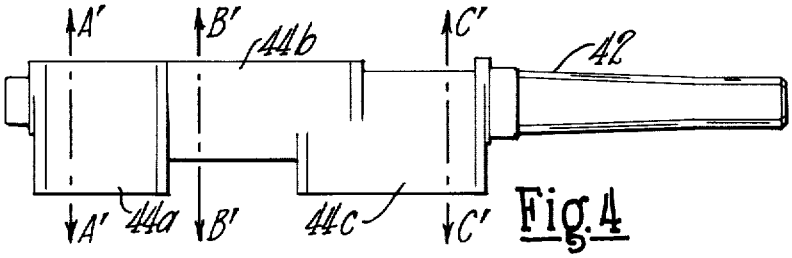
FIG. 4 is an enlarged longitudinal view of the actuating shaft of the pendant control of FIG. 1.
Figure 5A:
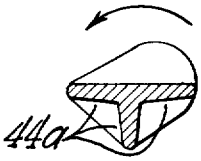
FIG. 5*a*, *b* and *c* are respective top section views of the three stepped sections of the actuating shaft of FIG. 4 taken along sections A′—A′, B′—B′ and C′—C′.
Figure 5B:
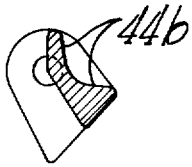
Figure 5C:
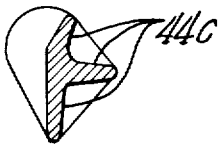

The control element sub-assembly 14 includes hoist control elements such as a packaged micro-switch group 30, a condenser 32, a pair of choke coils 34, a filter 36, and a rocker switch assembly 38. The rocker actuator assembly 38 has a thumb actuated rocker actuator 40 which is connected to an actuating shaft 42 having a series of actuating cams 44 formed at one end, as may be best seen in FIGS. 4 and 5. The packaged micro-switch group 30 is mounted between a pair of supports 46 shich are affixed to the base plate 26 by screws 48. The choke coils 34 are directly mounted to the base plate at opposite ends in the free end space of the main body 24 of the housing 12. The condenser 32 is mounted in the free space below the switch group 30 while the filter 36 is mounted at one end of the same switch group 30. The various mentioned control elements are connected to the control line 22 of the hoist in a manner well known to those skilled in the art to provide raising and lowering of the hoist at different speeds as well as appropriate hoist brake actuation upon actuation of predetermined micro-switches of the packaged group 30.

These various micro-switches are mechanically actuated by appropriate engagement of the cams 44 of the actuating shaft 42 with the actuating levers (not shown) of the predetermined individual micro-switches of the packaged group 30. To accomplish such actuation the shaft 42 is connected to the rocker actuator assembly 38 to rotate in response to thumb rotation of the rocker actuator 40. The shaft 42 is mounted through bearings (not shown) in the supports 46 to locate the cams 44 of the shaft 42 under the micro-switch group 30. The rocker actuator 40 is biased toward a neutral position by a spring 48 connected to the shaft 42 and the support 46 while a spring pressure catch 50 also mounted to the support 46 has mating surfaces, such as a detent and dimple, to retain the shaft in various positions other than neutral against the return force of the spring 48. Due to the above detailed mounting of the rocker actuator 40, the shaft 42 and the associated spring 48 and pressure catch 50 to the support 46 it is seen that the control sub-assembly 14 may be easily preassembled externally of the housing 12 where the elements are easily reached before final assembly thereto. Similarly, any required troubleshooting may be done by simply removing the sub-assembly 14 from the housing 12 to provide easy connection of test equipment.

Figure 6:
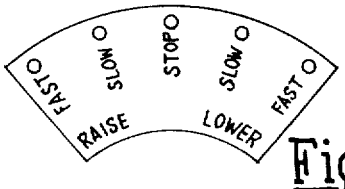
FIG. 6 is a schematic representation of the actuating positions of the main actuator of FIG. 1.

As may be best seen with particular reference to FIGS. 2 and 6, the rocker actuator 40 is thumb movable to two other positions on either side of the neutral position. The two positions on one side of neutral may be used to lower the hoist at a first slow speed while the second is a fast speed hoist lowering position. The two positions on the other side of the neutral position are slow and fast speed hoist raising positions. The pressure catch 50 retains the rocker actuator 40 in the mentioned positions once they are reached by the hoist operator moving the actuator 40 thereto. To move the actuator 40 between the mentioned positions the operator exerts sufficient force to overcome the retaining force of the catch 50 at which time the biasing force of the spring 48 will move the actuator 40 toward the neutral position.

Figure 3:
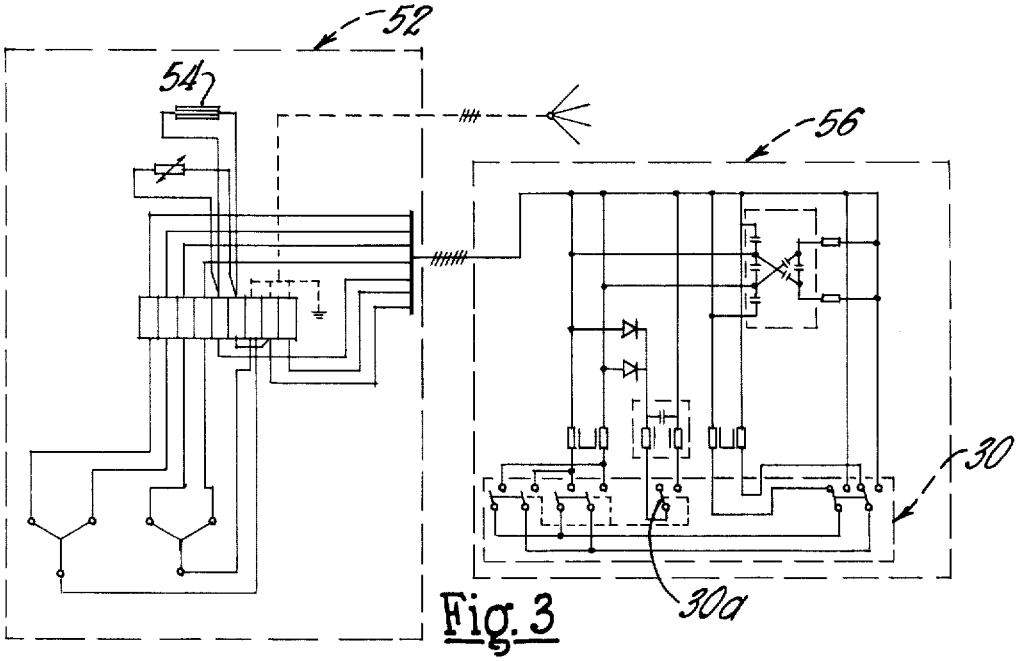
FIG. 3 is a schematic drawing of the electrical connections between the pendant switch assembly and a controlled hoist.

It is highly desirable that the pendant assembly 10 actuate a brake on the hoist (not shown) whenever the rocker actuator 40 is returned to the neutral position either from the hoist raising or hoist lowering positions. To accomplish this the pendant 10 is electrically wired to the hoist as may be best seen with particular reference to FIG. 3. One switch **30*a* of the switch package group 30 is actuated by the shaft 42 whenever the actuator 40 is in the neutral position. The closing of the contacts 30a establishes a control signal from a pendant switch group 56 to a hoist switch group 52. This control signal actuates a brake control 54** which brakes the hoist.

From the foregoing it will be appreciated by those skilled in the art that certain modifications and improvements may be made to the present invention. Such modifications and improvements have been purposely deleted for the sake of conciseness and readability but are intended to be within the scope of the claims to the invention.

I now claim:

1. A hoist pendant control assembly comprising:

a housing having a handle portion for grasping said housing and a main body for enclosing control elements therein;

a rocker actuator mounted within a recess formed in the handle portion of said housing to allow angular movement of the rocker by the hand of an operator grasping the handle, said actuator having a plurality of control positions;

a series of adjoining micro-switches mounted to a common base plate within the main body of said housing; and a multi-stepped shaft rotatable by rotation of said rocker actuator, the steps of said shaft being located proximate to said micro-switches to allow different degrees of shaft rotation to actuate different micro-switches.

2. A hoist pendant control assembly as set forth in claim 1 wherein the main body of said housing forms a pair of end located grooves for retaining said base plate.

3. A hoist pendant control assembly as set forth in claim 1 including a spring assembly connected to said shaft to bias said rocker switch toward a neutral position.

4. A hoist pendant control assembly as set forth in claim 3 including a pressure catch assembly connected to said shaft to retain said shaft in different micro-switch actuating positions.

5. A hand-held pendant for operator controlling a remotely located hoist by movement of a single actuator to different positions comprising:

a center divided housing forming a handle portion conforming to the hand of the hoist operator and also forming a body portion for enclosing control switches;

a main actuator mounted to the handle portion of said center divided housing to be movable by the thumb of the operator's hand holding the handle;

a series of hoist control switches mounted within the body portion of said center divided housing for controlling various hoist operations;

coupling means for actuating various ones of said series of hoist control switches in response to different positions of said main actuator;

a mounting plate having said series of hoist control switches mounted thereto and wherein said body portion of said center divided housing has formed therein a pair of end located grooves for retaining said mounting plate therebetween; and support means mounted to said mounting plate to retain said main actuator and said shaft in a proximate location to said series of control switches to allow said support means and said mounting plate to be retained between the end located grooves of said housing as a single unit.

6. A hand-held pendant as set forth in claim 5 wherein said main actuator is a rocker member having a neutral position and two other positions on one side of the neutral position and wherein said series of hoist control switches includes a hoist brake switch, a first hoist speed switch and a second hoist speed switch.

7. A hand-held pendant as set forth in claim 6 wherein said coupling means includes a shaft having three spaced step portions and being connected to said rocker member to rotate therewith, the step portions of said shaft being located proximate to said brake switch, said first switch, and said second switch to actuate said brake switch in the neutral position of said rocker member and to actuate said first switch and said second switch in the other two positions of said rocker member.

8. A hand-held pendant as set forth in claim 7 including a return spring connected to said shaft to bias said shaft toward the position actuating said brake switch.

9. A hand-held pendant as set forth in claim 8 including a pressure catch assembly for retaining said shaft in said first and second switch actuating positions to prevent the return of said shaft to said brake switch actuating position by said return spring.

* * * * *

UNITED STATES PATENT AND TRADEMARK OFFICE

CERTIFICATE OF CORRECTION

PATENT NO. : 3,931,486

DATED : January 6, 1976

INVENTOR(S) : Rolf L.M.Raetz

It is certified that error appears in the above-identified patent and that said Letters Patent are hereby corrected as shown below:

Col. 3, line 12: "Switch" should read "actuator".

Col. 3, line 18 "shich" should read "which".

Signed and Sealed this

*twenty-third* Day of *March 1976*

[SEAL]

*Attest:*

RUTH C. MASON
*Attesting Officer*

C. MARSHALL DANN
*Commissioner of Patents and Trademarks*